United States Patent [19]

Vinson

[11] Patent Number: 4,761,203

[45] Date of Patent: Aug. 2, 1988

[54] PROCESS FOR MAKING EXPANDED FIBER

[75] Inventor: Kenneth D. Vinson, Germantown, Tenn.

[73] Assignee: The Buckeye Cellulose Corporation, Memphis, Tenn.

[21] Appl. No.: 946,998

[22] Filed: Dec. 29, 1986

[51] Int. Cl.[4] ..... D21C 9/00

[52] U.S. Cl. ..... 162/9; 162/28; 162/158; 162/187; 241/21; 241/28

[58] Field of Search ..... 162/187, 28, 9, 234, 162/158; 241/21, 28

[56] References Cited

U.S. PATENT DOCUMENTS

| | | | |
|---|---|---|---|
| 1,770,430 | 7/1930 | Respess | 162/28 |
| 1,992,996 | 3/1935 | Dodge | 162/187 |
| 4,374,702 | 2/1983 | Turbak et al. | 162/9 |

*Primary Examiner*—Peter Chin

*Attorney, Agent, or Firm*—Leonard W. Lewis; Thomas J. Slone; Jerry J. Yetter

[57] ABSTRACT

A process for making mechanically expanded fiber from fibrous material having a fibrillar ultrastructure. The expanded fiber is made by impacting the fibrous material with a plurality of fine media. Impacting by the fine media causes the fibers to expand from a fibrous form to a highly fibrillated form, wherein fibrils separate from, or become substantially disassociated from, the fibrous material ultrastructure. Cellulosic fibrous material is particularly applicable to the process. Cellulosic fibrous material is preferably impacted with fine media at least until the cellulose-containing phase of an aqueous slurry containing 0.5%, by weight, of cellulosic material will retain at least fifty percent of the initial volume of such cellulose-containing phase upon unagitated settling for a period of sixty minutes.

6 Claims, 3 Drawing Sheets

PROCESS FOR MAKING EXPANDED FIBER

FIELD OF THE INVENTION

This invention relates to a process for making mechanically expanded fiber from fibrous material having a fibrillar ultrastructure.

BACKGROUND OF THE INVENTION

Expanded fiber is a substance made from fibrous material having a fibrillar ultrastructure, wherein the fibrous material has been processed in such a way as to cause fibrils to separate from, or become disassociated from, the fibrous material ultrastructure. Alternatively, expanded fiber can be considered as cellulosic fibrous material which has been expanded from a fibrous form to a fibrillar form. Expanded fiber from natural, cellulosic fibers is of particular interest herein.

Cellulosic fibers are multi-component ultrastructures made from cellulose polymers. Lignin, pentosans and other components known in the art may also be present. The cellulose polymers are aggregated laterally to form threadlike structures called microfibrils. Microfibrils are reported to have diameters of about 10-20 nm, and are observable with an electron microscope. Microfibrils frequently exist in the form of small bundles known as macrofibrils. Macrofibrils can be characterized as a plurality of microfibrils which are laterally aggregated to form a threadlike structure which is larger in diameter than a microfibril, but substantially smaller than a cellulosic fiber. In general, a cellulosic fiber is made up of a relatively thin primary wall, and a relatively thick secondary wall. The primary wall, a thin, net-like covering located at the outer surface of the fiber, is principally formed from microfibrils. The bulk of the fiber wall, ie, the secondary wall, is formed from a combination of microfibrils and macrofibrils. See Pulp and Paper Manufacture, Vol. 1, Properties of Fibrous Raw Materials and Their Preparation For Pulping, ed. by Dr. Michael Kocurek, Chapter VI, "Ultrastructure and Chemistry", pp 35–44, published jointly by Canadian Pulp and Paper Industry (Montreal) and Technical Association of the Pulp and Paper Industry (Atlanta), 3rd ed., 1983, incorporated herein by reference. The cellulosic fiber walls constitute the ultrastructure of the cellulosic fiber. Microfibrils and macrofibrils shall hereinafter be collectively referred to as "fibrils." Expanded fiber from cellulosic fibers thus refers to fibrils which have been substantially separated from or disassociated from a cellulosic fiber ultrastructure. Fibrous material in this condition shall hereinafter be referred to as being in "fibrillar" form.

Expanded fiber has a high proportion of surface area relative to conventional fibrous material. Expanded fiber from cellulosic fiber is particularly characterized by high binding ability, and high gellability. Expanded fiber has application in a variety of areas including strength additives, thickeners, extenders and carriers in a variety of structural products, foods, drugs, cosmetics, paints, and other industrial and chemical applications.

Production of expanded fiber, of any type, from fibrous material having a fibrillar ultrastructure involves expansion of the fibrous material from a primarily fibrous form to, at least, a partially fibrillar form. One method for producing expanded fiber from cellulosic, fibrous material is disclosed in U.S. Pat. No. 4,483,743, Turbak, et al., issued Nov. 20, 1984. Expanded fiber, referred to therein as microfibrillated cellulose, is produced by passing a liquid suspension of cellulose fibers through a small diameter orifice, in which the suspension is subjected to a pressure drop of at least 3000 psig and a high velocity shearing action, followed by a high velocity decelerating impact. Passage of the suspension through the orifice is repeated until a substantially stable suspension is obtained. While this method produces expanded fiber having desirable absorption and settling volume properties, it is not believed to provide efficiencies of scale which may be critical for competitiveness with competing cellulosic substances at mass production levels. Therefore, it is desirable to provide an alternative method of making expanded fiber.

Other methods in the paper industry having been proposed to increase the level of fibrillation conventionally observed for pulped, cellulosic fibers. For example, beating and additional refining of pulp in excess of the level conventionally practiced in order to provide a commercially saleable product are well known to to increase fibrillation. However, beating and refining as practiced in the cellulose fiber industry are relatively inefficient processes. Large amounts of energy are expansion and fibrillation. In relatively low amounts of fiber expansion and fibrillation. In these processes, the fiber is abraded to form a fiber having a "fuzzy" character, while the fiber walls, and hence the ultrastructure, are retained substantially intact. Beating and refining, generally implemented by abrasion and impacting of suspended fibers by entrapment between a rotor and stator, have been found to be of extremely limited utility for producing expanded fiber due to the prolonged period of fiber treatment necessary to achieve levels of fibrillation significant for the manufacture of expanded fiber. Another disadvantage of fibrillation by conventional beating and refining apparatuses is that a high level of wear would be incurred upon the apparatus surfaces.

Another type of cellulosic material made from cellulosic fibers is particulate cellulose. Various forms of particulate cellulose have been available for a number of years in the cellulose industry. Particulate cellulose is mechanically disintegrated, purified cellulosic fibrous material. As its name indicates, particulate cellulose exists in a particulate or powdered state rather than a fibrillated state. The particulate state is a result of mechanical processing which breaks a relatively large number of chemical bonds within the cellulosic fibrils and fibrous ultrastructure. Methods for producing particulate cellulose include conventional ball milling; and include, to produce particularly finely powdered cellulose, sonic pulverization with a modified ball mill. Although particulate cellulose is useful for a variety of applications including utilization as food additives, thickeners and extenders, it does not provide as high a degree of binding and gellability as obtained in connection with the use of expanded fiber.

Other types of finely divided celluloses are known which involve the use of chemical treatments in their manufacture, such as acid hydrolysis and mercerization. However, such additional chemical treatments lead to increased chemical and disposal costs and reduced yield of cellulosic product. One common form of cellulose made from chemically treated fibers is known as microcrystalline cellulose. The accessible amorphous regions of the fibers are chemically dissolved, leaving only the crystalline regions in the form of fine crystals. In addition to the disadvantages listed above, microcrystalline cellulose is also less reactive and absorptive than other finely divided cellulose forms.

It is therefore an object of this invention to provide a process for making expanded fiber from fibrous material having a fibrillar ultrastructure.

It is also an object of this invention to provide a process for making expanded fiber from cellulosic fibrous material without causing excessive cellulose chain degradation or cellulose dissolvation.

These objects, and other advantages that may be or become apparent to those skilled in the art, have been attained by the present invention which is described below.

SUMMARY OF THE INVENTION

According to the present invention, expanded fiber is produced by a process wherein fibrous material having fibrillar ultrastructure is mechanically fibrillated by impacting fine media against such fibrous material. This process involves the steps of:

a. impacting the fibrous material with a plurality of fine media such that fibrils of the fibrous material are separated from the fibrous material ultrastructure; and b. separating the fibrous material from the fine media.

Such treatment may be implemented with apparatuses known as a fine media mills, agitated fine media mills, and sandmills, Preferably, a horizonal fine media mill, wherein flow of fibrous material through the fine media mill occurs in a substantially horizontal direction, is utilized. Vertical fine media mills and media mills at angles between horizontal and vertical configurations are also believed to be applicable.

Fine media mills were originally used to de-agglomerate pigment dispersions, and have heretofore been used to grind materials in the chemical processing of inks, magnetic media, commercial herbicides and pesticides, among other products containing finely ground powdered materials. Considering that fine media mills, and the mechanical action imparted thereby, were heretofore utilized for making powders from nonfibrous material, it was surprising to discover that the type of mechanical action imparted by fine media mills provides an alternative method of making expanded fiber from fibrous material having a fibrillar ultrastructure such as cellulosic fibers.

DETAILED DESCRIPTION OF THE PREFERRED EMBODIMENTS

In accordance with the present invention, highly fibrillated fibrous material, hereinafter "expanded fiber", is produced by impacting fine media against such fibrous material. Impacting of the fine media against the fibrous material is continued at least until a portion of the fibrils of the fibrous material are separated from the fibrous material ultrasturcture.

The type of fibrous material which may be used with this invention include any fibrous material which has a tibrillar ultrastructure. This invention is especially useful for treatment of cellulosic fibers. Therefore, the remainder of this description shall primarily focus upon the manufacture of expanded fiber from cellulosic fibers.

Cellulosic fibers of diverse natural origins may be used, including softwood fibers, hardwood fibers, cotton linter fibers, and also fibers from Esparto grass, bagasse, hemp and flax. Fibers from chemically pulped fibrous sources, as well as fibers from mechanically pulped and chemimechanically pulped fibrous sources, may be used. Preferably chemically pulped fibers from wood sources are utilized, since such fibers are believed to be more efficiently fibrillated into expanded fiber. Specifically, chemically pulped fibers are preferred over mechanically pulped fibers such as groundwood, thermomechanical pulp, and chemithermomechanical pulp, since lignin present in mechanically pulped fibers binds the fibrils tightly in position and inhibits fiber plasticization. Consequently, fibrillation efficiency is low relative to similar treatment of chemically pulped wood fibers. Cellulosic fibers having substantial levels of hemicellulose are preferred over high alpha cellulose content fibers, such as cotton, characterized by the substantial absence of hemicellulose. High alpha cellulose content fibers can also be prepared from cellulosic fibers from wood and vegetable sources by chemical pulping methods. The reason for this preference of hemicellulose-containing fibers is that such fibers are more susceptible to plasticization, and the resulting plasticized fibers are more susceptible to fibrillation, than low hemicellulose fibers. Generally, fibers provided from conventional chemical pulp processes will have, by weight percent, between about 10% and about 15% hemicellulose. Fibers with hemicellulose levels within or above this range are preferred for the manufacture of expanded fiber according to the process herein disclosed.

Regardless of source, the fibers should be provided in an unsheeted form prior to initiation of mechanical expansion, to facilitate efficient and effective action by the media and flowability of the fibers through the equipment utilized to impact the fine media against the fibers.

Figure 1:
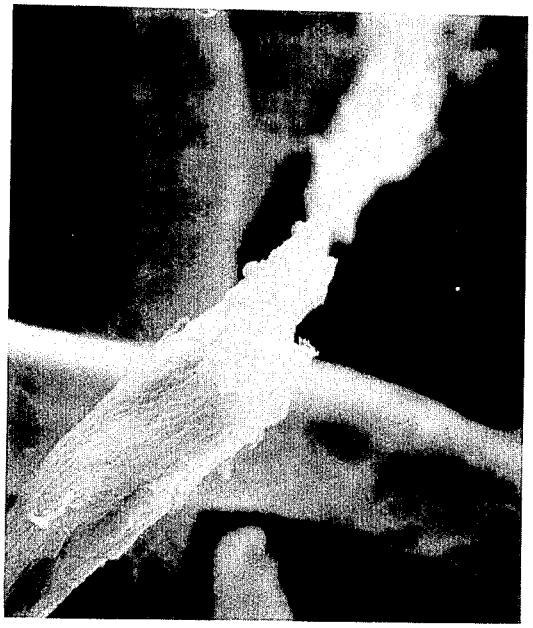
FIG. 1 shows a 1000X microphotograph of chemically pulped cellulosic wood fibers prior to treatment according to the present invention.
Figure 2:
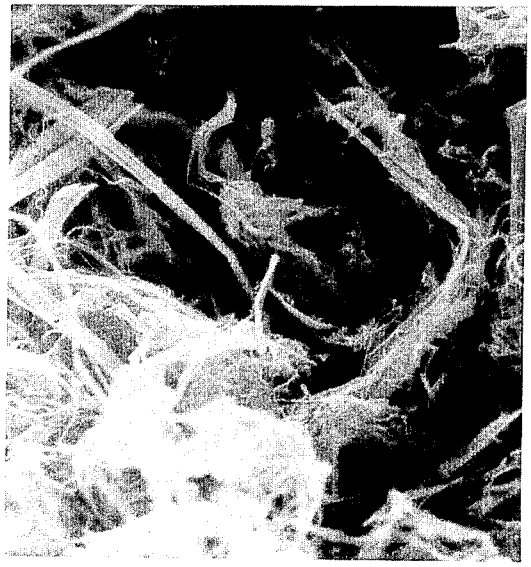
FIG. 2 shows a 1000X microphotograph of expanded fiber made according to the present invention, from fibers of the type shown in FIG. 1.

Upon mechanical impact with fine media, primarily interfibrillar bonds between cellulose molecules, such as mechanical bonds and hydrogen bonds are broken. With the affected bonds broken, the fibrils or parts thereof become separated from the fiber ultrastructure. This phenonenom is referred to as "expansion" of the fiber. Upon a sufficient level of impact with fine media, a substantial portion of the fiber is converted to a highly expanded, fibrillar state. Preferably, essentially the entire fiber is converted to such fibrillar state, wherein the fiber ultrastructure is substantially completely expanded to fibrillar form. Referring to FIG. 1, shown is a 1000X electron microphotograph of ordinary cellulosic fibers. FIG. 2 shows an electron microphotograph of expanded fibers at the same level of magnification. These figures exemplify the conversion of the fibrous material ultrastructure to fibrils in a fibrillar condition that occurs in the production of expanded fiber. It can be seen from these figures that cellulosic fiber ultrastructures are presented in FIG. 1, whereas the fibers in FIG. 2 have been expanded to fibrillar form, with the substantial absence of the former ultrastructures.

In order to facilitate mechanical expansion by the action of fine media, the fibers should be softened, ie. plasticized, as previously discussed. This can be accomplished by contacting the fibers with a polar liquid, such as (but not limited to) water and ethylene glycol, prior to or during the initial stages of mechanical expansion. The amount of fluid required to plasticize chemically pulped fibers in general will correspond with the amount of fluid required to induce swelling of the fibers. Typically, a slurry having a fiber consistency of, by weight percent, less than about 50% is preferred. However, as discussed below, larger amounts of fluid will generally be desired in order to facilitate transport of the fibrous material.

Significantly, impact of the fine media against the fibers results in mechanical expansion of the fibers into individualized microfibrils. Such microfibrils have high surface area and high cellulose chain length relative to particulate, powdered, or finely chopped fibrous, cellulosic material. These differences in chain length and surface area are believed to contribute significantly to the high absorptivity, gellability and strength-providing characteristics of expanded fiber.

In the preferred embodiments, fibrous material is impacted with media with a fine media mill. Fine media mills may be alternatively referred to as agitated media mills, agitated fine media mills, and sand mills. Fine media mills are described generally in "Horizontal Media Milling With Computer Controls," Modern Paint and Coatings, June 1984, by Christ Zoga, hereby incorporated by reference into this disclosure. Vertical and horizontal agitated media mills, both described therein, are both applicable to the present invention. In general, a fine media mill has a cylindrical tube, a rotatable shaft disposed inside the tube, a plurality of impellers attached to the rotatable shaft, means for rotating the shaft, fine media disposed inside the tube, and means for separating the expanded fiber from the fine media. The purpose of the impellers is to agitate the fine media and thereby facilitate impact of the media against the material to be treated. The cylindrical tube is vertically oriented for vertical agitated media mills, and is horizontally oriented for horizontal agitated media mills. Horizontal agitated media mills are preferred, due to better flow through the mill and higher media loading capability. Higher media loading capacity enables the horizontal agitated media mill to operate at higher efficiency and produce treated product in shorter periods of time. The impellers in horizontal mills serve an additional function of restricting direct flow through the mill. Horizontal agitated media mills are commercially available from Premier Mill Corporation, New York, NY.

Sandmills, a category of vertical fine media mills, as exemplified in U.S. Pat. Nos. 3,545,687, 3,995,818, 3,960,331, 3,685,749, 3,984,055, and 4,140,283 are also contemplated for fibrillation of fibrous material, and the above-referenced patents are hereby incorporated by reference into this disclosure.

A variety of types of fine media may be used to expand fibrous material. These include glass beads, ceramic beads, zirconium silicate beads, zirconium oxide beads, and steel or other metal shots. The fine media may be spherical, elliptical, or of another geometric shape. The fine media may rounded or angular edges. The equivalent diameters of the fine media are preferably between about 0.5 mm and about 3 mm, wherein equivalent diameter is calculated according to the following equation:

$$ED = \left(\frac{6 \cdot V}{\pi}\right)^{\frac{1}{3}} \quad (1)$$

where

ED is equivalent diameter; and

V is volume of an individual fine media.

In operation, rotation of the impellers of the media mill propel the fine media, thus causing the fine media to impact against the fibrous material. The velocity at which the fine media must strike the fibers in order to effect expansion into fibrillar form will depend upon the type, size, and weight of the fine media, the degree of plasticization of the fibers. Efficiency of fibrillation will additionally depend upon the percentage of fibers and fine media in the media mill relative to the volume of the area wherein fibrillation occurs. For practical purposes, there will exist a minimum speed at which the fine media must impact against the fibers to achieve substantial levels of fibrillation. This level will depend upon the factors listed above. In general, higher levels of fibrillation will be associated with higher proportions of a particular type and shape of fine media in a given media mill. Factors affecting fibrillation will be exemplified in more detail below and in the examples.

Upon settling, a well mixed slurry of cellulosic fibrous material generally tends to separate into a cellulose-containing phase and a non-cellulose-containing phase. For convenience and practicability, expanded fiber from cellulosic fibrous material within the scope of this invention is defined in terms of the consistency of an aqueous slurry of the fibrous material for which, upon 60 minutes undisturbed settling of a well mixed, 0.5% consistency aqueous slurry (fibrous material percentage of slurry, weight basis) in the substantial absence of emulsifying or other stabilizing agents, the post-settling cellulose-containing phase of the slurry retains at least 50% of the volume of the slurry.

The consistency at which a cellulose-containing phase of an aqueous solution as described above separates into equal volumetric parts of cellulose-containing slurry and noncellulose-containing water after a 60 minute period of unagitated settling, shall hereinafter be referred to as the 50% volumetric reduction settling consistency. This consistency hereinafter referred to shall be calculated on a weight basis wherein the weight of fibrous material, in expanded or unexpanded form, is determined as a percentage of the total weight of the aqueous slurry. Thus, expanded fiber within the scope of the above definition will have a 50% volumetric reduction settling consistency of 0.5% or less. For reference, conventional, chemically pulped cellulosic fibers which have been cut to pass through a standard 60 mesh screen (ASTM E-11) will ordinarily have a 50% volumetric reduction settling consistency of about 2%. That is, the cellulose fibers in a 2% consistency slurry of such fibers will settle to 50% of their initial displacement after a period of undisturbed settling of 60 minutes. As discussed above, expanded fiber will have a settling consistency is less than about 0.5%. Preferably, the settling consistency is less than about 0.1%. It will be understood by those skilled in the art that aqueous slurries of expanded fiber prepared at consistencies greater than the 50% volumetric settling consistency will have 50% volumetric reductions of the expanded fiber-containing phase in excess of 50% of the initial volume upon 60 minutes of unagitated settling.

The following procedure was utilized to determine the 50% volumetric reduction settling consistency of cellulosic fibrous. First, a series of at least three aqueous slurries containing the cellulosic material treated according to this invention of varying consistencies is prepared. Each slurry is placed in a separate 50 ml graduated cylinder. The slurries are simultaneously agitated and then allowed to settle under unagitated conditions for a period of sixty (60) minutes. Unagitated settling will result in at least partial settling of the cellulosic material to form a cellulose-containing phase and a non-cellulose containing phase. At the end of the settling period, the volume of the cellulose-containing phase is determined from each graduated cylinder. This is referred to as the settling volume. The consistencies of the slurries are chosen such that at least one solution has a consistency prior to settling which is believed to be greater, and one which is believed to be less, than the 50% volumetric reduction settling consistency. A plot is made of settling volume, in terms of percentage of the original volume, versus fiber consistency of the solution, in terms of weight percent immediately subsequent to agitation. A curve is then made from the plotted data points. The 50% volumetric reduction settling consistency is interpolated from the curve at the point where the settling volume at the 50% level intersects with the curve.

The method described above may also be utilized to determine the 50% volumetric settling consistency of cellulosic fibrous material plasticized or impacted with the media in a liquid medium other than water. Any nonaqueous liquid medium should be substantially removed from the fibrous material prior to or simultaneously with preparation of the aqueous slurries described above. Techniques such as extraction or drying may be utililzed to accomplish removal of the nonaqueous liquid medium. Subsequent to removal of the nonaqueous liquid medium, the 50% volumetric reduction settling consistency of the fibrous material in an aqueous slurry can be determined as described in the preceding paragraph.

Figure 3:
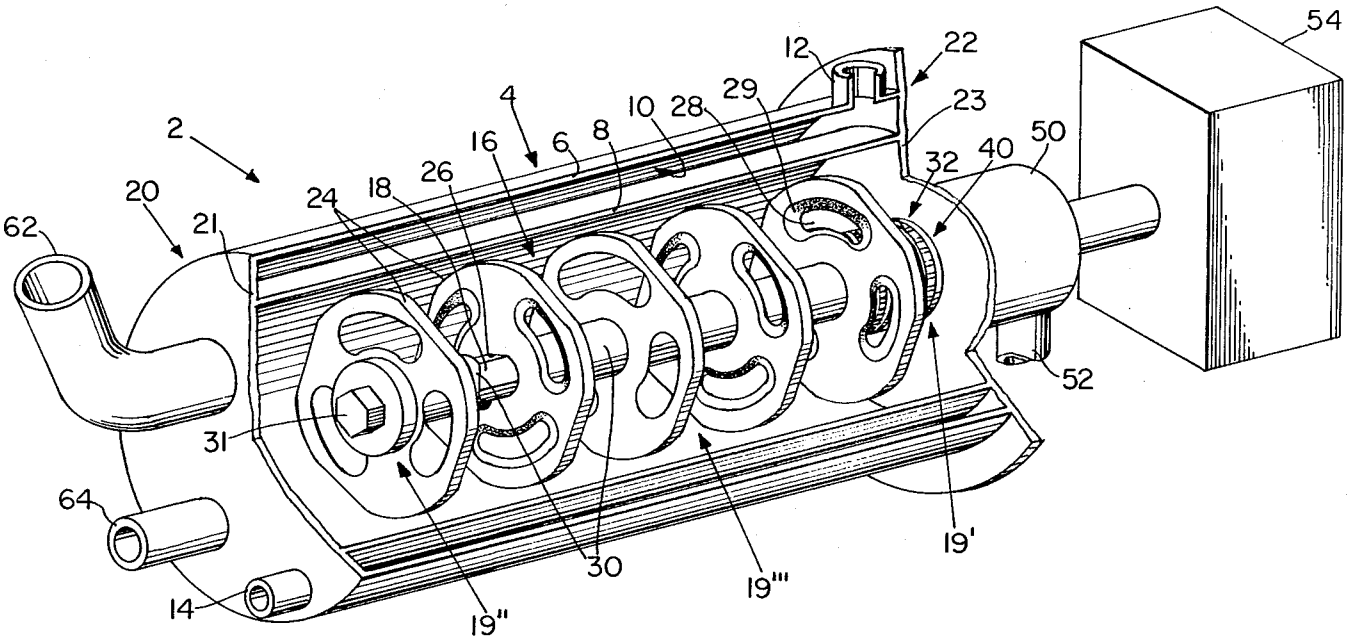
FIG. 3 shows a horizontal fine media mill.
Figure 4:
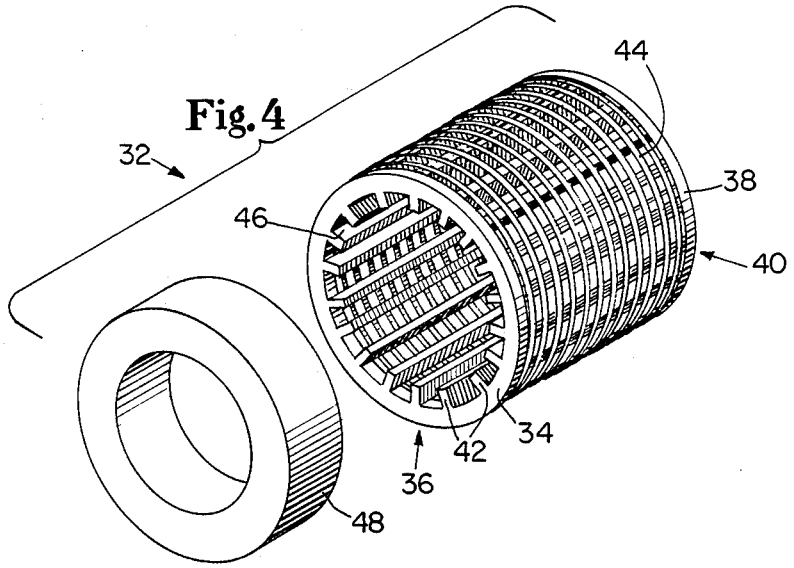
FIG. 4 shows an enlarged view of a screen element for the horizontal fine media mill of FIG. 3.
Figure 5:
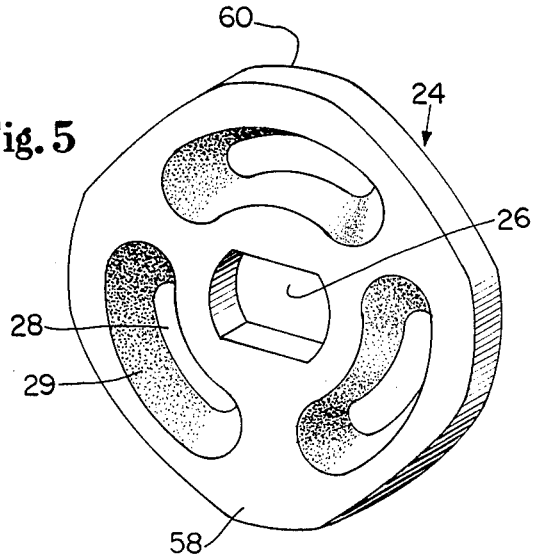
FIG. 5 shows a top angular view of an impeller of the type shown in the horizontal fine media mill of FIG. 3.

Referring now to FIG. 3 shown is a horizontal fine media mill 2. The fine media mill 2 has a metal casing 4 having an outer cylindrical jacket 6, an inner cylindrical jacket 8, and a cooling water region 10 between the outer cylindrical jacket 6 and the inner cylindrical jacket 8. Cooling water is inputed to the cooling water region 10 through a cooling water inlet 12 located in the outer cylindrical jacket 6. The cooling water exits through a cooling water outlet 14. The casing 4 has a slurry input end 20, with a casing end plate 21, and a slurry output end 22 with a casing end plate 23. Inside the inner cylindrical jacket 8 is a fibrillating region 16. Disposed within the following region 16 is a beveled drive shaft 18 which extends from the slurry input end 20 through the slurry output end 22. The drive shaft 18 has a plurality of impellers 24 through which the drive shaft 18 passes. The drive shaft 18 is cylindrical at a first end region 19', and is beveled at a second end region 19'' and at a central region 19'''. The second end region 19'' and the central region 19''' correspond to portions of the drive shaft 18 whereat the impellers 24 are positioned. Referring to FIGS. 3 and 5, the impellers 24 have beveled central orifices 26 through which the drive shaft 18 passes, such that rotation of the drive shaft 18 is accompanied by rotation of the impellers 24. Each impeller 24 has a front surface 58, a back surface 60, and a plurality of fibillating region orifices 28 which facilitate flow of media and fibrous material through the fibrillating region 16. The fibrillating region orifices 28 have contoured edges 29 to facilitate flow of the slurry of fibrous material. The impellers 24 are separated and held in position on the drive shaft 18 by cylindrical separator tubes 30. The cylindrical separator tube 30' is shown in cutaway form, to display the beveled drive shaft 18. A removable cap 31 is provided at the second end region 19'' of the drive shaft 18 which prevents the impellers 24 and cylindrical separator tubes 30 from sliding off of the drive shaft 18. A primary inlet 62 and a secondary inlet 64 are located at the inlet end 20 of the media mill 2, and extend through the casing end plate 21. At the slurry outlet end 22, a media screen 32 is disposed about the drive shaft 18. Referring to FIG. 4, an expanded view of the cylindrical, unbeveled media screen 32 is shown. The media screen 32 has a bracing ring 34 at a gasket end 36 of the media screen 32 and a bracing ring 38 at a fibrous material output end 40 of the media screen 32. The bracing rings 34, 38 are connected by a plurality of beams 42 which are disposed about the drive shaft 18 when the media screen 32 is in place. A helical ring element 44 forms a screen around the beams 42. The helical ring element 44 is designed to prevent media from flowing through the media screen 32, but allow fibrous material to pass through without clogging. A resilient gasket 48 is juxtaposed against the gasket end 36 of the media screen 32 to prevent media from entering the region between the bracing ring 34 and the drive shaft 18 when the media mill 2 is in use. In use, referring to FIGS. 3 and 4, fibrous material is forced through the helical ring element 44 to the region 46 between the helical ring element 44 and the drive shaft 18. This region has a thickness approximately corresponding to the height of the beams 42. The fibrous media slurry then passes through the output end 40 of the media screen 32 to a seal chamber 50. The seal chamber 50 has a fibrous slurry outlet 52 from which the slurried fibrous material is collected.

The drive shaft 18 passes through the seal chamber 50 to a drive means 54, such as an electric motor. The seal chamber 50 is designed to prevent any substantial amount of fluid from exiting the seal chamber 50 along the drive shaft 18, so as to prevent fluid from reaching the drive means 54. A resilient gasket disposed around the driveshaft 18, or other means known to those skilled in the art, may be utilized to effect such seal.

Cooling water is circulated through the cooling water region 10 during operation to prevent excessive buildup of heat. Although not shown in the figures, media as previously described are provided in the fibrillating zone 16. A slurry of fibrous material is pumped into the fibrillating zone 16 through one of the fibrous slurry input valves 62, 64. The drive shaft 18 and impellers 24 are rotated at a desired rate by the drive means 54. The impellers facilitate flow of the slurry through the fibrillatory zone, and continual redistribution of the media, thereby inducing impact of the media against the fibrous material throughout the fibrous material slurry. The impellers and media screen may vary in design from the impellers 24 and media screen 32 shown in FIG. 3.

In order to obtain a particular 50% volumetric reduction settling consistency, it may be necessary to subject the fibrous material to two (2) or more passes through the fine media mill. The number of passes through the fibrillating apparatus required to obtain a particular level of fibrillation or a particular 50% volumetric reduction settling consistency will depend upon the type and number of impellers, the rate of rotation of the impellers, the consistency of the slurry, the size, type, and amount of media, the residence time of the fibrous material in the apparatus, and other factors not specifically mentioned here, but which will be understood by those skilled in the art upon a reading this disclosure. Since the level of fibrillation of the cellulosic fibers imparted by each pass through a fine media mill is variable. In some cases the ultrastructure of the fibrous material remain sufficiently intact such that clogging at the media screen may occur.

One method for reducing occurrence of clogging at the media separation screen and increasing efficiency of fibrillation without altering media mill or operating parameters thereof is to cut the fibers prior to treatment with the media mill. This can be done with a knife cutter or other pulp processing apparatus suitable for reducing the length of cellulosic fibers. One commercial source of suitable knife cutters is Sprout Waldron Engineering of Muncie, Pennsylvania.

Another method for increasing the level of fibrillation imparted by one pass through the media mill is to suspend cut or uncut fibers in a slurry also containing expanded fiber. It has been found that more efficient fibrillization is obtained when the untreated fibers are suspended in the fibrous slurry with fibrous material which has been expanded to fibrillar form. It has been found that combining the fibrous material to be treated with expanded fiber increases the level of fibrillation of the fibrous material to better enable such material to pass through media screening devices.

The following examples are presented to illustrate the invention. Unless otherwise indicated, all percentages are calculated on a weight basis.

EXAMPLE 1

Dry, bleached, southern softwood kraft pulp (SSK) fibers were sufficiently cut with a knife cutter such that the dry fibers were able to pass through a standard 60 mesh screen (ASTM E-11). The cut fibers were mixed with water to form an aqueous slurry having a 2%, by weight, fiber consistency. The fibers in the slurry were then expanded by treatment with a horizontal fine media mill of the type shown in FIGS. 3, 4, and 5. The mill was made by Premier Mill Corporation (New York, NY). Specifically, a Model No. 1.5VSD horizontal media mill having a 1.5 liter fibrillating zone volume and five impellers was used. The number and type of impellers were as shown in FIGS. 4 and 5. The fibrillating zone contained 80% (by volume of the fibrillating zone) of 1.5 mm effective diameter fine media made from glass. The fine media were substantially elliptical in shape and did not have sharply angled edges. The media screen had 13 mil apertures between passes of the helical ring element and 63 mil apertures between the beams at the juncture between the beam and the helical ring element. The height of the beams ie. approximately the distance between the inner surface of the helical ring element and the rotatable shaft of the media mill, was about 67 mils.

The SSK slurry was passed through the media mill while the impellers were spinning at a rate of 2550 rpm, corresponding to a 2000 foot/minute impeller peripheral speed. The media mill was cooled with ambient temperature cooling water, to maintain slurry temperature to less than about 40° C.

The slurry was passed through the fibrillating zone for a total of 5 passes in a closed-loop, batch system at the following volumetric flow rates: Pass 1, 22 gal./hr.; Pass 2, 8.5 gal./hr.; Pass 3, 5 gal./hr.; Pass 4, 5 gal./hr.; and, Pass, 5, 5 gal./hr. The 50% volumetric reduction settling consistency of the cellulosic material was determined after each pass through the fibrillating zone. The following 50% volumetric reduction settling consistencies were obtained after each of the passes through the fibrillating zone: Pass 1, 0.60%; Pass 2, 0.30%; Pass 3, 0.10%; Pass 4, 0.08%; and Pass 5, 0.05%. The cellulosic material was sufficiently expanded after Pass 2 to exhibit the gel-like resistance to settling that is characteristic of the herein defined expanded fiber. The slurry became more viscous with each pass through the fibrillating zone, although the magnitude of the decreases in 50% volumetric reduction settling consistency were relatively small in the later passes through the fibrillating zone.

EXAMPLE 2

The purpose of this example was to investigate the effect of lower slurry consistency or efficiency of mechanical expansion of fibrous material. A 1% slurry pulp was prepared from SSK cellulosic fibers dry ground on a knife cutter to pass through a 60-mesh screen (ASTM E-11). The media mill, the type and amount of fine media, and the rotational rate of the impellers were the same as described in Example 1. The slurry was passed through the fibrillating zone in a closed-loop batch system is described in Example 1 for a total of six (6) passes. The volumetric flow rate was monitored and the 50% volumetric reduction settling consistency of the cellulosic material was determined for each pass, with the following results being obtained: Pass 1–15 gal./hr., 0.87%; Pass 2–11.3 gal./hr., 0.23%; Pass 3–15 gal./hr., 0.18%; Pass 4–15 gal./hr., 0.10%; Pass 5–15 gal./hr., 0.08%; Pass 6 - 15 gal./hr., 0.07%. More passes were required for the fiber consistency slurry than for the 2% fiber consistency slurry of Example 1 in order to reduce the 50% volumetric reduction settling consistency to below about 0.10%.

EXAMPLE 3

The purpose of this example was to investigate the effect of higher slurry consistency on efficiency of mechanical expansion of fibrous material. The same media mill, type and amount of fine media, and rotational rate of the impellers as in Example 1 were practiced. Expanded fiber from SSK pulp having a 50% volumetric reduction settling consistency of 0.07% was combined with a 1% consistency slurry of unexpanded SSK fibers dry cut to pass through a 60-mesh screen (ASTM E-11 spec). The dry weight ratio of unexpanded fibers to expanded fiber was 3:1. The final slurry had a fiber consistency of 4% by weight. The expanded fibers were added to suspend the unexpanded fibers in the slurry. This prevented settling which could lead to plugging in the pump or at the media screen. The slurry was passed through the fibrillating zone in a closed-loop batch system, as in Example 1, for a total of two (2) passes. The following 50% volumetric reduction settling consistencies were obtained at the end of each pass at the indicated volumetric flow rates: Pass 1–9 gal./hr., 0.18%; and Pass 2–3 gal./hr., 0.08%. Relative to Examples 1 and 2, the increase in the fiber consistency of the slurry in this example significantly increased efficiency of mechanical expansion of the fibrous material and reduced the number of passes required to achieve a particular 50% volumetric reduction settling consistency.

EXAMPLE 4

The purpose of this example was to prepare expanded fiber from pulp fibers without precutting the fibers as described in the previous examples. This was done by recycling a portion of expanded fiber from the output of the media mill and combining the recycled expanded fiber with uncut, unexpanded pulp fibers.

The same media mill and type and amount of fine media as described in Example 1 were utilized. The impeller peripheral speed was 2100 feet/minute, corresponding to a rotational speed of 2675 rpm. Seventy-five (75) grams/min. water were mixed with 168 grams/min. recycle and fed into the media mill at a primary inlet. At a secondary inlet, SSK pulp fibers were fed by plunger into the media mill at a rate of 2.25 grams/min. fiber with 5 grams/min. water. After steady-state operation was achieved, the media mill produced 82 grams/minute of 2.74% consistency expanded fiber slurry. The expanded fiber had a 50% volumetric reduction settling consistency of less than 0.5%. No clogging of the media screen was experienced.

EXAMPLE 5

In this example, expanded fiber was prepared from a 4% consistency slurry of SSK fibers without utilizing expanded fiber as a suspending aid. The media mill, type and amount of fine media, and impeller rotational speed were the same as described in Example 4. A 4% consistency aqueous slurry of SSK pulp fibers was prepared from fibers cut to pass through a 100-mesh screen (ASTM E-11). The slurry was first passed through the fibrillating zone at a rate of 200 grams/min. Clogging at the media screen was experienced and the mill was shut down. Next, the media mill was run on a semi-continual basis wherein the cellulosic slurry was twice passed through the media mill. For the first pass, the slurry was pumped at a rate of 2400 grams/minute for one 5 second period per minute. For the second pass, the slurry was pumped at a rate of 2400 grams/minute for one 3.8 second period per minute. Clogging was not experienced. After only two (2) passes, expanded fiber having a 50% volumetric reduction settling consistency of 0.10% was obtained.

EXAMPLE 6

In this example, ethylene glycol was substituted for water as the polar liquid for plasticizing the fibers. A 4% consistency slurry of SSK pulp fibers and ethylene glycol was prepared and treated by a semi-continuously run media mill as described in Example 5, using the same type of fibers cut to pass through a 100-mesh screen (ASTM E-11), the same type and amount of fine media, and the same rotational rate of the impellers. After only one (1) pass, the cellulosic material was determined by microscopic examination and comparison to previously made expanded fiber to be sufficiently fibrillated to qualify as expanded fiber having a 50% volumetric reduction settling consistency of less than about 0.5%.

EXAMPLE 7

The purpose of this example is to exemplify mechanical expansion of cellulosic fibers other than SSK fibers. A 2% consistency slurry of bleached, northern softwood kraft pulp (NSK) fibers was prepared from NSK fibers cut to pass through a 60-mesh screen (ASTM E-11). The slurry was treated with a media mill according to the conditions described in Example 1. The volumetric flow rate was monitored and settling consistency was determined for each pass through the fibrillating zone. The following results were obtained for volumetric flow rate and 50% volumetric reduction settling consistency: Pass 1–13 gal./hr., 0.41%; Pass 2–7.5 gal./hr., 0.19%; Pass 3–5.0 gal./hr., 0.09%; and Pass 4–5.0 gal./hr., 0.04%. Greater levels of mechanical expansion per pass through the fibrillating zone were obtained relative to Example 1, wherein SSK fibers were treated.

From the foregoing specification, one skilled in the art can easily ascertain the essential characteristics of this invention, and without departing from the spirit and scope thereof, may make various changes and modifications to adapt the invention to various usages and conditions not specifically mentioned herein. The scope of this invention shall be defined by the claims which follow.

What is claimed is:

1. A process for making expanded fiber from fibrous material having a fibrillar ultrastructure, comprising:

a. sufficiently impacting said fibrous material with a plurality of fine media, to cause fibrils to separate from said fibrous material, thereby providing expanded fiber characterized by a 50% volumetric reduction settling consistency, calculated on an aqueous slurry weight basis, of less than about 0.5%; and b. separating said expanded fiber from said fine media.

2. A process as described in claim 1 wherein said impacting is continued at least until said fibrous material, in an aqueous slurry, has a 50% volumetric reduction settling consistency, calculated on an aqueous slurry weight basis, of less than about 0.1%.

3. A process according to claim 1 which is carried out in a polar liquid medium selected from the group consisting of water and ethylene glycol.

4. A process according to claim 2 which is carried out in a polar liquid medium selected from the group consisting of water and ethylene glycol.

5. A process as described in claim 1, wherein said fibrous material comprises chemically pulped wood fibers.

6. A process as described in claim 5 which is carried out in ethylene glycol.

* * * * *

UNITED STATES PATENT AND TRADEMARK OFFICE

CERTIFICATE OF CORRECTION

PATENT NO. : 4,761,203

DATED : August 2, 1988

INVENTOR(S) : Kenneth D. Vinson

It is certified that error appears in the above-identified patent and that said Letters Patent are hereby corrected as shown below:

Column 2, lines 22-24, delete "Large amounts of energy are expansion and fibrillation. In relatively low amounts of fiber expansion and fibrillation" and insert therefor --Large amounts of energy are expended to gain relatively low amounts of fiber expansion and fibrillation.--

Column 4, line 5, "tibrillar" should be --fibrillar--.

Column 4, line 54, "phenonemom" should be --phenomenon--.

Column 5, line 67, "The fine media may rounded or angular edges." should be --The fine media may have rounded or angular edges.--

Column 6, line 65, "is" should be --of--.

Column 7, line 7, "fibrous" should be --fibers--.

Column 7, line 35, "the" should be --fine--.

Column 9, line 11, "upon a reading" should be --upon reading--.

Column 9, line 13-14, "variable. In" should be --variable, in--.

UNITED STATES PATENT AND TRADEMARK OFFICE

CERTIFICATE OF CORRECTION

PATENT NO. : 4,761,203

DATED : August 2, 1988

INVENTOR(S) : Kenneth D. Vinson

It is certified that error appears in the above-identified patent and that said Letters Patent is hereby corrected as shown below:

Column 10, line 34, "is" should be --as--.

Signed and Sealed this

Thirteenth Day of December, 1988

*Attest:*

DONALD J. QUIGG

*Attesting Officer*

*Commissioner of Patents and Trademarks*